United States Patent [19]

Sanders

[11] 4,369,549

[45] Jan. 25, 1983

[54] BLENDING METHOD USING A ROVING DISINTEGRATOR-DISPENSER

[75] Inventor: John H. Sanders, Newport News, Va.

[73] Assignee: Badische Corporation, Williamsburg, Va.

[21] Appl. No.: 150,517

[22] Filed: May 16, 1980

[51] Int. Cl.[3] ..... D01G 13/00; D01H 5/22

[52] U.S. Cl. ..... 19/145.7; 19/97.5; 19/105; 19/236

[58] Field of Search ..... 19/145.5, 145.7, 236, 19/304, 97.5, 105

[56] References Cited

U.S. PATENT DOCUMENTS

| | | | |
|---|---|---|---|
| 2,052,869 | 9/1936 | Coanda | 28/271 X |
| 2,093,415 | 9/1937 | Camp | 19/145.7 |
| 3,577,599 | 5/1971 | Goldammer et al. | 19/145.5 |
| 3,670,485 | 6/1972 | Brown et al. | 19/145.7 X |
| 3,727,270 | 4/1973 | Marshall | 19/236 X |
| 3,793,679 | 2/1974 | Marshall | 19/236 X |
| 4,064,599 | 12/1977 | Neuenschwander | 19/145.7 |

FOREIGN PATENT DOCUMENTS

| | | | |
|---|---|---|---|
| 1960593 | 7/1971 | Fed. Rep. of Germany | 19/145.7 |

*Primary Examiner*—Louis Rimrodt

*Attorney, Agent, or Firm*—R. B. Hurley, Jr.

[57] ABSTRACT

A method and apparatus for blending a "primary staple" with a "secondary staple" wherein the weight ratio of the primary staple to the secondary staple is between 10,000:1 and 10:1 is disclosed. The secondary staple is continuously supplied to a blending machine (already working a primary staple) by drafting a textile roving. The drawn roving is then disintegrated into the secondary staple by an air flow amplifier. The air flow amplifier also supplies an air flow to transport the secondary staple to a blending machine, where it is blended into the primary staple.

12 Claims, 5 Drawing Figures

BLENDING METHOD USING A ROVING DISINTEGRATOR-DISPENSER

BACKGROUND OF THE INVENTION

1. Field of the Invention

A method and apparatus for blending a "primary staple" with a "secondary staple" wherein the weight ratio of the primary staple to the secondary staple is between 10,000:1 and 10:1 is disclosed. The secondary staple is continuously supplied to a blending machine (already working the primary staple) by either drafting or simply feeding a textile roving into an air flow amplifier (preferably a Transvector brand air flow amplifier) to disintegrate the drawn roving into the secondary staple. The secondary staple is subsequently transported to the blending machine, and blended therein with the primary staple. The method is particularly useful in making blends having a secondary staple which imparts a desired characteristic to the resulting mixture, such as conductivity, coloration, etc., or a multiplicity of such characteristics.

2. Prior Art Statement

The blending of staple fiber was originally done by a batch method, often manually. Box-car blenders (U.S. Pat. No. 3,577,599) were developed in place of manual blenders. The manual or box-car blends are subsequently carded to produce a uniform web. Continuous blending by introduction of a secondary fiber into a carding machine which is operating on a primary staple is known in the art. For example, continuous filament yarn has been introduced into partially carded material in a carding machine (U.S. Pat. No. 3,670,485). The continuous filament was broken up into staple and the resulting mixture was blended on the carding machine (U.S. Pat. No. 3,670,485). A web of fibrillated film has been introduced into a carding machine and blended therein (U.S. Pat. No. 3,690,057). Also, A textile roving has been cut up and dispensed onto the web of a card to produce a mottled fabric (U.S. Pat. No. 2,093,415).

SUMMARY OF THE INVENTION

The present invention relates to a blending method employing a particular apparatus, herein designated as a roving disintegrator-dispenser, enabling a roving to be disintegrated into its component staple fibers and dispensed into a blending machine. The choice of roving to be dispensed is dependent upon the desired characteristics of the resulting blend. The advantage of the present invention lies in the production efficiency and flexability due to operational advantages when using a roving disintegrator-dispenser. The novelty of the present invention lies in the means of disintegrating and transporting the secondary staple, the use of a roving in a process for blending, and the use of a drafting frame to relatively remove twist and relatively untangle the staple fibers comprising a roving so that the roving is weakened and may be easily disintegrated.

It is therefore an object of the invention to efficiently produce a blend comprised of at least one minor substituent, having between 0.01% and 10% of the minor constituent by weight.

It is a further object of the invention to have a continuous uninterrupted process having the option to include, exclude, or accurately meter-in any desired amount of the minor constituent.

DETAILED DESCRIPTION OF THE PREFERRED EMBODIMENTS

Figure 1:
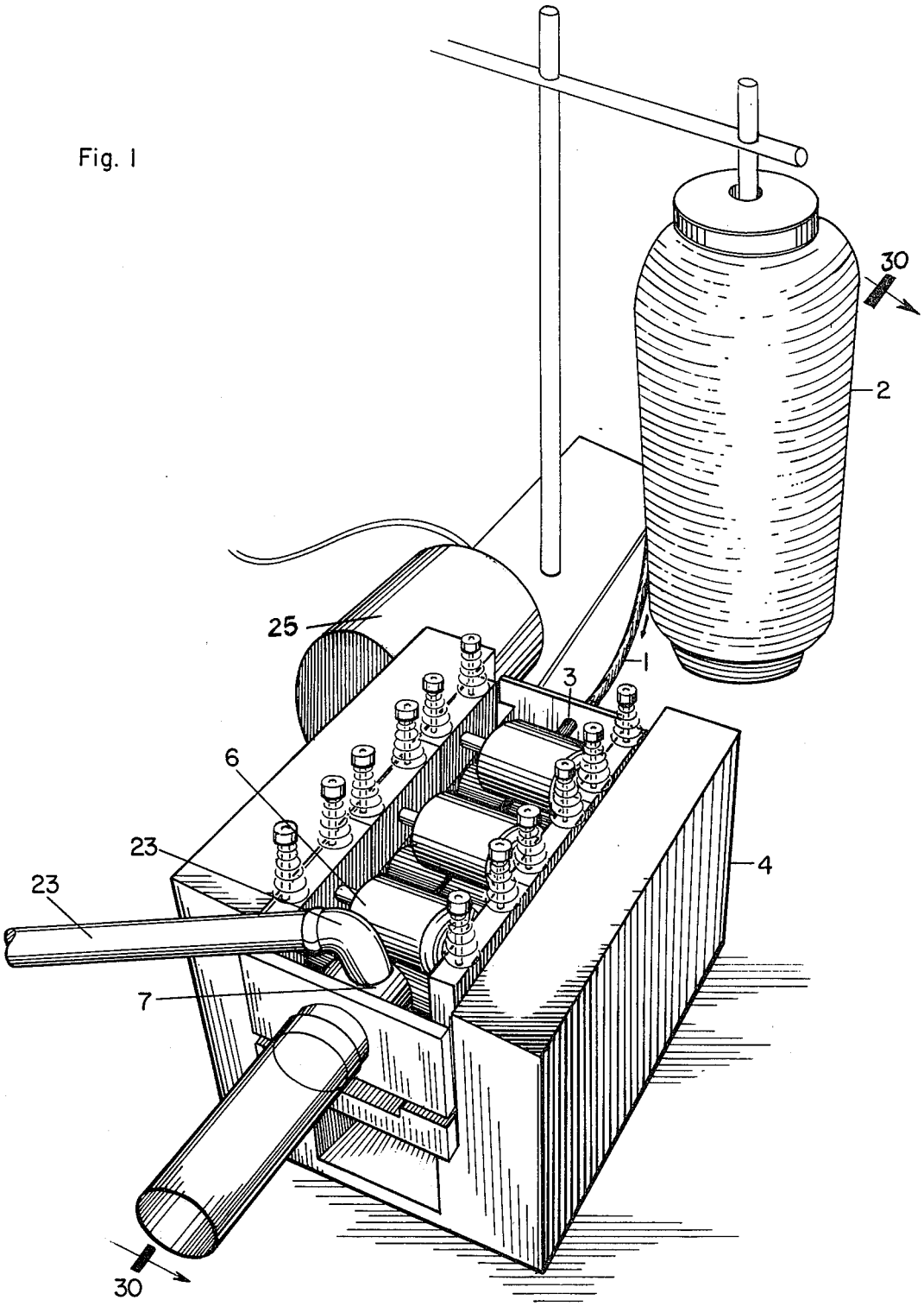
FIG. 1 is a perspective view of the roving disintegrator-dispenser used in the blending process.
Figure 2:
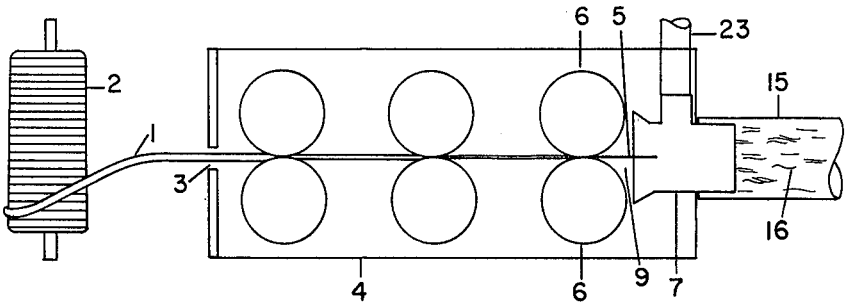
FIG. 2 is a cross-sectional view of the roving disintegrator-dispenser taken through line 30—30 of FIG. 1.

While this invention may be embodied in many different forms, it will be described primarily in terms of the preferred embodiment (FIGS. 1–4), to shed light on the principles and means of operation as opposed to all possible variants.

In the operation of the present blending method, a roving (1) from a source of roving (2) is threaded through an inlet (3) into the drafting frame (4). After the roving is drawn by the drafting frame, the drawn roving (5) emerges from the last roller set (6) of the drafting frame and is induced into the entrance port (8) of an air flow amplifier (7). The air flow amplifier is positioned with its entrance port (8) in the immediate vicinity of the last roller set (6) of the drafting frame (4) so that the region of emergence (9) of the drawn roving (5) from the last roller set (6) of the drafting frame (4) is affected by the air induced (10) into the air flow amplifier, to induce the drawn roving (5) into the air flow amplifier (7). Air is supplied to an air flow amplifier (7) via a conduit (23) attached to a source of compressed air (11) so that the resulting flow through the air flow amplifier (the resulting flow being the sum of the primary flow (13) and the secondary, or induced flow (10) is large enough to both induce the drawn roving (5) into the air flow amplifier, and to pull upon the drawn roving with enough force to continuously disintegrate the drawn roving (5) into the secondary staple fiber (16). The staple fiber liberated from the roving is carried through and out the exit port (14) of the air flow amplifier, and into a conduit (15) attached to the exit port (14) of the air flow amplifier (7). The conduit (15) carries the contents discharged from the air flow amplifier (7), including the air (20) supplied to the air flow amplifier (7) from compressed air source (11) (resulting in primary airflow (13), the air induced (10) into the air flow amplifier (7), and the staple (16) liberated by the disintegration of the drawn roving (5) (i.e. the secondary staple). In the preferred embodiment of the invention, the conduit (15) conducts its contents to a blending machine (17), such as a card or picker, and the secondary staple (16) is subsequently blended with the primary staple (18) on the blending machine (17).

Figure 3:
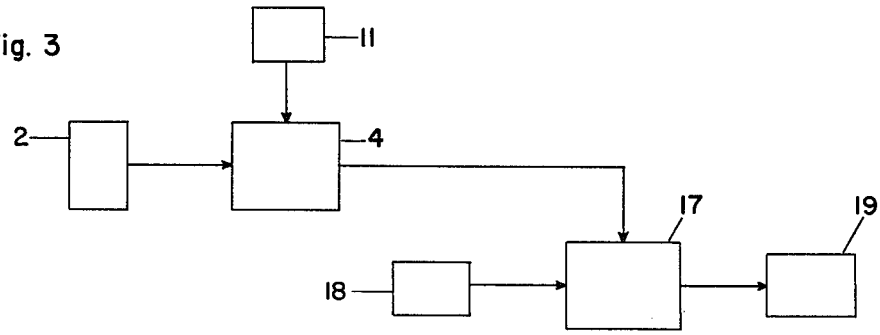
FIG. 3 is a schematic representation of the blending process.

The blending method is shown schematically in FIG. 3. The staple fiber (16) coming from the roving disintegrator dispenser (4) is supplied to a blending machine (17). The blending machine is supplied with a relatively large amount of "primary staple" (18) plus the "secondary staple" which is supplied from the roving disintegrator-dispenser (4). The primary staple (18) is fed into the carding machine as any bulk staple fiber conventionally fed into a carding machine. The staple fiber supplied by the roving disintegrator-dispenser is termed "secondary staple" due to its lesser relative abundance in the resulting blend (19). The disintegrator-dispenser may be supplied with more than one roving. The rovings may be identical or each roving may possess different characteristics. In a process involving a roving disintegrator-dispenser working two unlike rovings, the resulting blend (19) is comprised of both a "primary staple" (18) plus two "secondary staples" (16).

The blending process of the present invention lends itself to the efficient production of blends having one or more minor components (i.e., "secondary staples") in the range below 10% each. The minor components are "produced twice", first as roving already produced from staple fiber once, and second, converted back to staple fiber by the roving disintegrator-dispenser and then reprocessed. A method such as this is only efficient when dispensing relatively small amounts of the secondary staple into relatively large amounts of the primary staple, as any attempt to increase the proportions of the secondary staple significantly above 10% of the weight of the total blend would be more efficiently done in another prior art manner, such as box car blending, etc. The present method is particularly useful for blends of conductive fiber, as the proportion of conductive (secondary) staple is typically between 1% and 0.05%. The method is also particularly useful for blending a relatively small proportion of any staple (or staples) having a desired characteristic which may be imparted to a blend comprising a low proportion of the secondary staple.

The function of the roving disintegrator-dispenser restricts its use solely to blending processes, because there is no purpose in disintegrating a roving per se. Therefore, the apparatus described for disintegrating and dispensing a roving is conceived to be useful only for a blending process of the type described herein.

Figure 5:
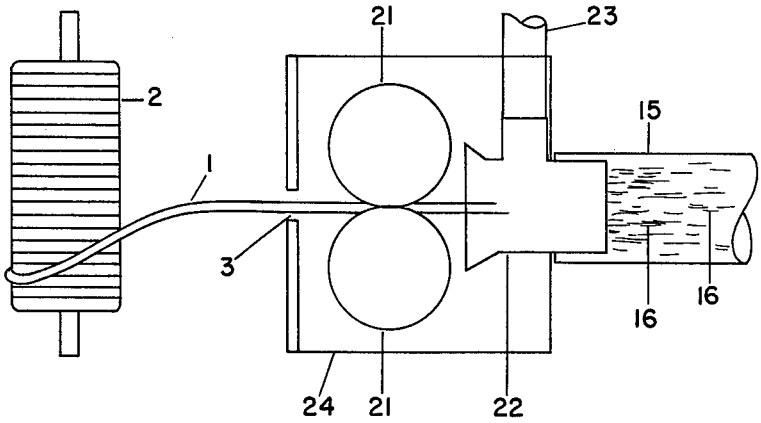
FIG. 5 is another embodiment of a roving disintegrator-dispenser.
Figure 4:
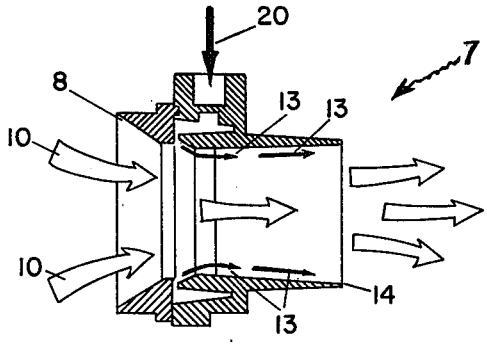
FIG. 4 is a longitudinal cross-section of a transvector as used in the present apparatus, including designation of induced and supplied airflows.

The continuous pulling force created by the airflow through the air flow amplifier need only be strong enough to disintegrate the drawn roving. The resulting fragments of drawn roving may range from slightly more than one staple length to several staple lengths. The amount of pulling force necessary to carry out the process is directly proportional to the strength of the drawn roving, and therefore indirectly proportional to the drafting ratio for any given roving. In another embodiment of the method, an undrafted roving is simply fed into air flow amplifier (22) by a roving feeding device (e.g., a pair of feed rolls (21)). In this embodiment (see FIG. 5) the amount of pulling force necessary to disintegrate the roving will be considerably higher, necessitating the higher airflow from the compressed air source through the air flow amplifier. The preferred embodiment is the drafting frame disintegrator-dispenser, because of the low air flow rate necessary to disintegrate the drawn roving, resulting in a more easily controlled, quieter process. The motor (25) powering a drafting frame (4) or feeding apparatus (24) is preferably of variable rpm, so that the rate of roving fed to the air amplifier may be adjusted to any desired rate of dispensation to result in the desired proportion of secondary staple (16) in the resulting blend (19).

The means for creating a continuous pulling force to disintegrate and transport the roving may include several types of devices which are classified as air flow amplifiers, namely Transvector brand air flow amplifiers, Coanda airmovers, ejectors, and venturis. The drawn roving is weak enough to be pulled apart with little force, so that the air flow amplifier used need only operate at a fraction of its amplification ratio. The amplification ratio is the ratio of the quantity of air moving out the exit port of the air flow amplifier to the quantity of air moving into the air flow amplifier from the compressed air source (i.e. the "primary flow"). The design of Transvector brand air flow amplifiers creates the highest amplification ratio (therefore low suction) of any of the amplifiers listed supra (A Short Course On Transvector Air Flow Amplifiers, Vortec Corp., 1976). The Transvector has an amplification ratio range of 1:1 to 100:1, but for the purpose of the preferred embodiment of this invention, the amplification ratio need not be greater than 20:1, but any desired ratio may be employed. The invention is conceived to be operable with air flow amplifiers generally, not just Transvectors. Because Transvector brand air flow amplifiers refer to a specific brand of air flow amplifiers for which there is no generic terminology, we shall refer to them as transvectors henceforth and shall intend the general design and operational characteristics as opposed to any specific brand of air flow amplifier. We shall adopt the same lexical interpretation of Coanda airmovers, henceforth termed coandas.

Although transvectors, coandas, ejectors, and venturis are classified as air flow amplifiers, their operation is dependent upon a "fluid environment", the term fluid including gases and liquids in addition to air, although air is obviously the most practical fluid for the present method.

The disintegrated roving is conducted and dispensed into a "blending machine". The "blending machine" specifically includes carding machines and pickers. The location on the blending machines to which the disintegrated roving is dispensed is highly variable. In the case of a carding machine, the disintegrated roving may be dispensed into the blending reserve, the scotch feed, the feed rolls, the chute feed, or the doffer. The disintegrated roving may also be dispensed into the feed rolls of a picker.

In an operating roving disintegrator-dispenser, a 1 hank conductive roving (i.e. a roving weighing 0.6 gm/m) having a staple length of 2 inches, was drafted at a 10:1 ratio. The drafted roving exited the last roller pair of the drafting frame at a speed of 25 m/min (=1.5 gm/min). The drawn roving was continuously induced into a transvector air flow amplifier. The transvector was supplied with 15 psi pressure from a compressed air source, to produce a continuous primary flow of 25 liters per minute through the Transvector. The drawn roving, continuously induced into the Transvector, was thereafter disintegrated into individual staple fibers and small tufts of relatively parallel and untangled staple fibers by the continuous pulling force created by the airflow through the transvector. The airflow exiting the exit port of the transvector carried the staple and staple tufts from the disintegrated roving into and through a conduit directed onto the scotch feed at the breaker section of a woolen card. The woolen card operated at 45 kilograms per hour and received 1.5 gm/min of conductive staple from the roving disintegrator-dispenser supra. The resulting blend had 0.2% conductive staple. The distribution of the conductive staple in wool was excellent.

The conductive roving used in the above operation was conductive arcylic fibers made by Badische Corportion of Williamsburg, Virginia. Operation of the roving disintegrator-dispensor is not limited to conductive acrylic roving, but is conceived to include any roving of natural or man made staple fiber.

We claim:

1. A method of blending a primary staple with a secondary staple, comprising the steps of:

(a) drafting a textile roving in a drafting frame;

(b) exerting a continuous pulling force on a drawn roving with an air flow amplifier which pulls continuously upon the drawn roving in both disintegrate the drawn roving into the secondary staple and to transport the secondary staple to a blending machine;

(c) blending the secondary staple with the primary staple on a blending machine already working the primary staple.

2. A method of blending as described in claim 1 wherein the air flow amplifier is a transvector.

3. A method of blending as described in claim 1 wherein the air flow amplifier is a coanda.

4. A method of blending as described in claim 1 wherein the air flow amplifier is an ejector.

5. A method of blending as described in claim 1 wherein the air flow amplifier is a venturi.

6. A method of blending as described in claim 1 wherein there is at least one difference between the characteristics of the primary staple and the characteristics of the secondary staple.

7. A method as described in claim 1 wherein the secondary staple is conductive.

8. A method as described in claim 1 wherein the secondary staple is transported through a conduit by fluid flow.

9. A method as in claim 1 wherein the secondary staple is blended into the primary staple on a carding machine.

10. A method as in claim 1 wherein the secondary staple is transported to the blending reserve of a carding machine.

11. A method as in claim 1 wherein the weight proportion of the primary staple to the secondary staple is between 10:1 and 10,000:1.

12. A method of blending a secondary staple into a primary staple, comprising the steps of:

(a) drafting a textile roving in a drafting frame;

(b) exerting a continuous pulling force on the roving with a transvector so that the drawn roving is disintegrated;

(c) conducting the disintengrated drawn roving to a blending machine, via a conduit attached to the exit port of the transvector;

(d) blending the secondary staple into the primary staple on a blending machine.

* * * * *